United States Patent [19]

Breeckner

[11] 4,068,544

[45] Jan. 17, 1978

[54] MOTORCYCLE CLUTCH TOOL

[76] Inventor: Gregory P. Breeckner, Candlewood Shores, Brookfield, Conn. 06804

[21] Appl. No.: 724,030

[22] Filed: Sept. 16, 1976

[51] Int. Cl.[2] ..... B25B 13/48; B25B 13/02

[52] U.S. Cl. ..... 81/3 R; 81/121 R; 81/71

[58] Field of Search ..... 81/3 R, 55, 90 B, 121 R, 81/121 B, 71

[56] References Cited

U.S. PATENT DOCUMENTS

| | | | |
|---|---|---|---|
| 2,810,313 | 10/1957 | Hermanson | 81/90 B |
| 2,813,450 | 11/1957 | Dzus | 81/90 B |

*Primary Examiner*—James L. Jones, Jr.
*Assistant Examiner*—James G. Smith
*Attorney, Agent, or Firm*—Mattern, Ware, Davis & Stoltz

[57] ABSTRACT

A motorcycle clutch tool for securing the clutch hub assembly to the clutch shell so as to facilitate removal of the clutch hub assembly during maintenance operations incorporates a unitary rigid disc having a central opening and a plurality of radially extending tabs or slots for engagement with the inner periphery of the clutch shell. The disc includes a second plurality of tabs or apertures about its inner periphery for engagement with the outer periphery of the clutch hub assembly. When so engaged, the clutch shell is secured to the clutch hub assembly thereby permitting easy disengagment of both the clutch hub nut and the drive sprocket from the drive sprocket shaft. The clutch tool also incorporates a handle attached to the disc for positioning and imparting torque to the disc or, alternatively, a female socket attached to the disc for engagement with the male socket of a ratchet drive tool.

7 Claims, 7 Drawing Figures

MOTORCYCLE CLUTCH TOOL

BACKGROUND OF THE INVENTION

1. Field of the Invention

The present invention relates to motorcycle clutch tools and in particular, clutch tools for securing the clutch hub assembly to the clutch shell so as to facilitate maintenance procedures performed on motorcycle clutch assemblies.

2. Description of the Prior Art

The motorcycle clutch tool of the present invention includes a disc having radially extending tabs or slots for engagement with the inner slots or tabs of the clutch shell of a motorcycle and centrally located tabs or apertures about a central aperture in the disc for engagement with the outer periphery of the clutch hub assembly. The clutch hub assembly and clutch shell are thus securable to each other; thereby allowing the clutch hub nut to be easily removed. Otherwise, the clutch hub is able to rotate since, upon removal of the clutch pressure plate, the drive and driven clutch plates are free to rotate with respect to each other.

The present invention also includes a handle attached to the disc, or a female socket for engagement with a ratchet driving tool, for positioning the disc between the hub assembly and clutch shell. The handle or ratchet tool also allows torque to be applied to the disc to counterbalance torque applied to the clutch hub nut so as to facilitate loosening of this nut. The torque applied to the disc may also counterbalance torque applied to the drive sprocket nut during its removal so as to remove the drive sprocket from the drive shaft.

Although clutch tools have been made by the motorcycle user in the past for securing the clutch hub assembly to the clutch shell during the maintenance procedure, these tools required one to fabricate them from drive and driven clutch plates. The user was thus required to have at least two extra clutch plates from which a clutch tool could be fabricated by welding the plates together while maintaining them in the proper orientation. In *Chilton's TRUIMPH Motorcycle Repair and Tune-up Guide,* 1967 Ed., at page 58, such a clutch tool is shown in an illustration. This clutch tool, however, does not provide a unitary homogeneous rigid disc having radially extending tabs or recesses for engagement with a clutch shell and inwardly radially projecting tabs for engagement with a clutch hub assembly, nor does it disclose or suggest integral placement of a handle to this unitary disc or attachment of a female socket for engagement with a ratchet driving tool so as to position the disc within the clutch shell and clutch hub assembly and to apply torque thereto during extraction of the clutch hub nut from the clutch assembly or the sprocket nut from the drive sprocket.

Also, in *Chilton's HARLEY-DAVIDSON Motorcycle Repair and Tune-Up Guide,* 1971 Ed., at page 44, a clutch tool No. 97175-55 is disclosed for use in disassembly of the motorcycle clutch assemblies. This tool also utilizes a drive and driven clutch plate welded together as mentioned above and does not include a handle attached to a unitary disc.

SUMMARY OF THE INVENTION

A motorcycle clutch tool of the present invention incorporates a unitary homogeneous rigid disc which is specifically adapted for engagement with both the inner periphery of the clutch shell and the outer periphery of the clutch hub assembly of a motorcycle clutch assembly. The outer periphery of the unitary rigid disc incorporates either a plurality of tabs or recesses specifically shaped and positioned for engagement with the inner periphery of the clutch shell for a particular type of motorcycle as well as a plurality of inwardly radially extending tabs or apertures for engagement with the outer periphery of the clutch hub assembly of this motorcycle type. The unitary discs come in a variety of sizes to fit the clutch shells and clutch hub assemblies of motorcycles made by various manufacturers. In addition, the motorcycle clutch tool incorporates either a unitary handle rigidly attached to the unitary disc or a female socket similarly attached to the disc, for engagement with the male socket portion of a ratchet driving tool so as to allow easy maneuverability of the disc with respect to the clutch shell and clutch hub assembly as well as to apply torque to this disc during removal of the clutch hub nut or sprocket nut securing the drive sprocket to the drive shaft. This torque counterbalances the torque applied to the clutch hub nut or the drive sprocket nut during their respective removals from the clutch hub assembly and drive sprocket.

OBJECTS OF THE INVENTION

Therefore, it is a principal object of the present invention to provide a motorcycle clutch tool for securing and immobilizing the clutch hub assembly of a motorcycle so as to facilitate disassembly thereof;

An additional object of the present invention is to provide a motorcycle clutch tool of the above description that also secures and immobilizes the drive sprocket so as to facilitate removal of the drive sprocket from the drive shaft;

Another object of the present invention is to provide a motorcycle clutch tool of the above description incorporating a unitary handle for facilitating positioning of the unitary disc of the tool as well as applying torque to this disc to counterbalance the torque applied to the clutch hub nut or drive sprocket nut;

A still further object of the present invention is to provide a motorcycle clutch tool of the above description incorporating a female sprocket attached to the unitary disc of the present invention so as to allow a ratchet driving tool to mate with this sprocket and thereby allow positioning and torque application to the disc while providing for easy disengagement of the ratchet tool from the clutch tool during storage thereof;

A further object of the present invention is to provide a motorcycle clutch tool of the above description that is inexpensive to manufacture and easy to store;

Other objects of the present invention will in part be obvious and will in part appear hereinafter.

THE DRAWINGS

For a fuller understanding of the nature and objects of the invention, reference should be had to the following detailed description taken in connection with the accompanying drawings, in which.

DETAILED DESCRIPTION

Figure 1:
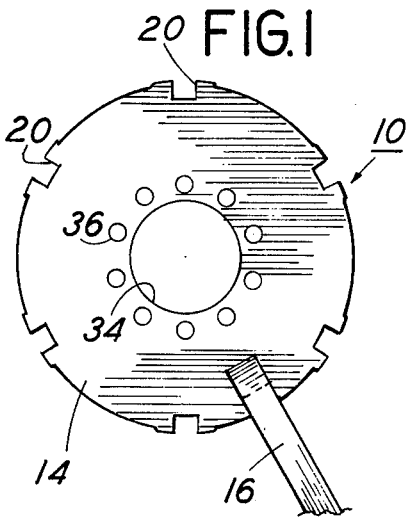
FIG. 1 is a partially cut away top plan view of a motorcycle clutch tool according to the present invention adapted for use with the clutch shell and clutch hub assembly of one manufacturer's clutch assembly.
Figure 3:
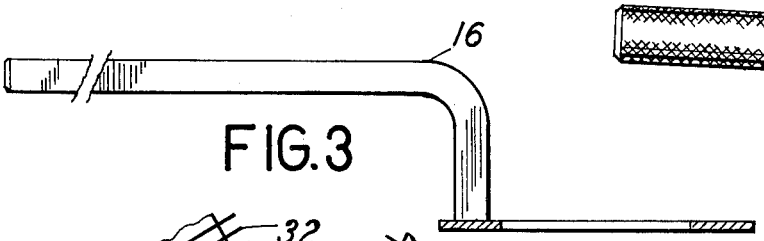
FIG. 3 is a partially cut away side elevational view of the motorcycle clutch tool of FIG. 1.
Figure 6:
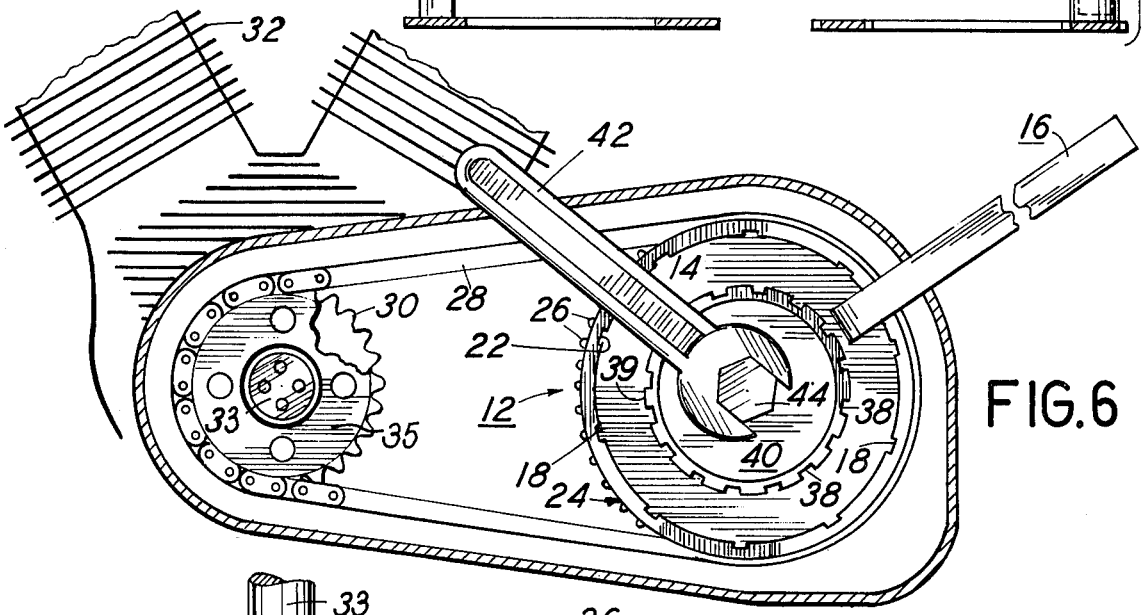
FIG. 6 is a side elevational view of a motorcycle clutch assembly and drive mechanism illustrating the manner in which the motorcycle clutch tool of the present invention is utilized in disassembling a motorcycle clutch assembly.

As best seen in FIGS. 1, 3 and 6, a clutch tool 10 for facilitating the removal of a motorcycle clutch assembly 12 incorporates a unitary homogeneous rigid disc 14 and a handle 16 securely attached to the disc, such as by welding and extending radially away from the disc in a plane substantially parallel to that of the disc. The handle preferably has an elongated L-shape as best seen in FIG. 3 so as to allow the user to have a substantial moment arm for applying torque to the tool.

Figure 2:
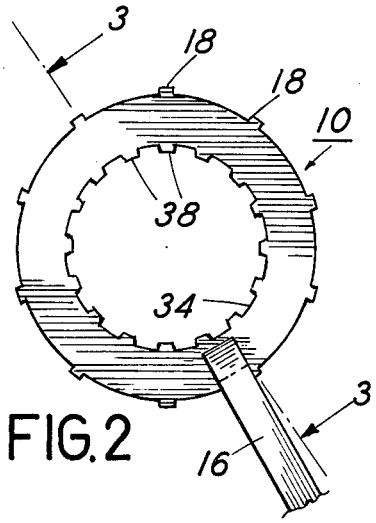
FIG. 2 is a partially cut away top plan view of another motorcycle clutch tool according to the present invention adapted for use with another manufacturer's motorcycle clutch assembly.
Figure 4:
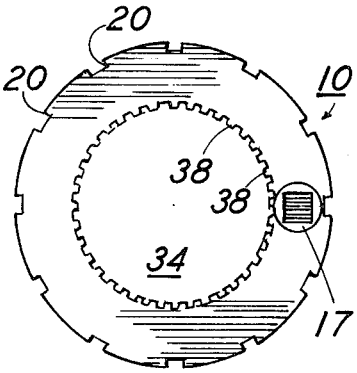
FIG. 4 is a top plan view of a third type of motorcycle clutch tool for use with another manufacturer's motorcycle clutch assembly illustrating an alternative embodiment of the present invention utilizing a female sprocket attached to the disc of the motorcycle clutch tool and adapted for mating with a ratchet driving tool.

The disc of the clutch plate tool is configured for use with a particular manufacturer of motorcycle clutch assembly as best seen in FIGS. 1, 2 and 4. As best seen in FIGS. 1, 2, 4, 6 and 7, the outer periphery of the disc comprises a plurality of tabs 18 or a plurality of recesses 20 spacially arranged so as to engage with the recesses 22 or tabs (not shown) of a clutch shell or basket 24. The disc is preferably fabricated from a strong metallic material such as 0.093 inch thick steel.

Figure 7:
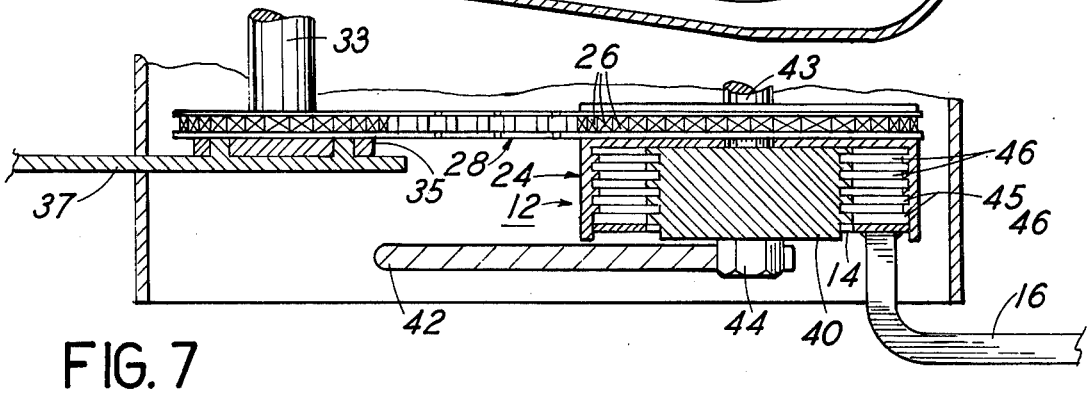
FIG. 7 is a partially cut away top plan view of the clutch tool and motorcycle clutch assembly and drive mechanism shown in FIG. 6.

As seen in FIGS. 6 and 7, the clutch shell of a typical motorcycle clutch assembly incorporates a plurality of radially extending teeth 26 which intermesh with links of drive chain 28 driven by drive sprocket 30 which in turn is powered by motorcycle engine 32 by drive shaft 33. Sprocket 30 is typically engaged with shaft 33 by means of a sprocket locking nut or bolt 35.

As best seen in FIGS. 1, 2, 4, 6 and 7, the inner portion of disc 10 incorporates a central aperture 34 and either a plurality of holes 36 about aperture 34 or a plurality of inwardly extending tabs 38 for engagement with the radially extending teeth 39 of a clutch hub assembly 40 of a particular motorcycle manufacturer. While so engaging the clutch hub assembly, the outwardly extending tabs 18 of disc 14 engage the recesses 22 of clutch shell 24 so that the clutch hub assembly is fixedly engaged with the clutch shell 24. Handle 16 allows the user to position the disc 14 between the clutch hub assembly and the clutch shell 24 and allows the user to apply torque to the disc so as to counterbalance torque applied to a wrench 42 placed about a clutch gear extension nut 44. In normal operation, one of the drive clutch plates 45 and one of the driven clutch plates 46 must first be removed in order to insert disc 10 between the clutch hub assembly and clutch shell. If desired and as generally preferable, the remaining drive and driven clutch plates may also be removed before disc 10 is positioned.

Without the present clutch tool, removal and disengagement of clutch gear extension nut 44 requires two people, because the drive and driven clutch plates 45 and 46 are free to move with respect to each other. Therefore, the clutch hub assembly freely rotates when a wrench 42 is applied to nut 44. The drive and driven clutch plates are free to move relative to each other, since the clutch pressure plate and pressure spring which normally maintain frictional contact between these plates must be removed by the user before he is able to reach the clutch gear extension nut 44. Thus, the firm interconnection between the clutch shell 24 and the clutch hub assembly 40 is lacking at the time the user is ready to remove clutch hub extension nut 44. To remove the clutch hub nut without the present tool requires one person to apply the brakes to the rear wheel, which is coupled to shaft 43 engaged with clutch hub assembly 40, and to thereby counteract the torque applied to wrench 42 attempting to free clutch hub extension nut 44. Removal of the clutch gear extension nut is thus greatly facilitated by the present invention, since the clutch hub may be maintained in a desired position by the clutch tool through its intermeshing with both the clutch hub assembly and the clutch shell.

As best seen in FIGS. 6 and 7, once the clutch tool is properly positioned onto the clutch hub assembly 40 and clutch shell 24, the user can apply torque to the clutch hub assembly by exerting force against handle 16 while simultaneously exerting force to wrench 42 and thereby applying torque to clutch gear extension nut 44. Once clutch gear nut 44 is loosened and removed, the clutch hub assembly is easily removed. The remaining drive and driven clutch plates may then be extracted if not previously removed as mentioned above. Thus, rapid removal of the entire clutch assembly 12 is obtained by use of the clutch tool 10.

By locking the clutch hub assembly 40 to the clutch shell 24, the present invention also prevents movement of drive chain 28. Immobilization of drive chain 28 prevents drive sprocket 30 and drive shaft 33 from turning. Thus, removal of sprocket locking nut 35 is facilitated by the present tool since the torque applied by a sprocket shaft wrench 37 to this nut is counterbalanced by the tool and will not cause the drive shaft and drive sprocket to turn as would otherwise occur.

Figure 5:
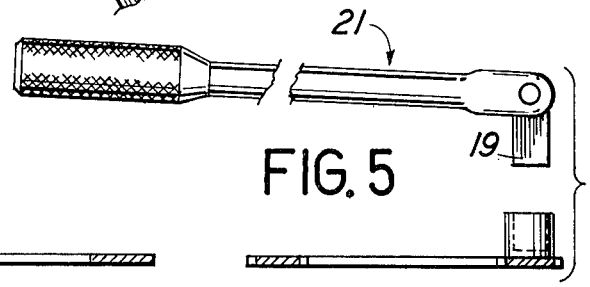
FIG. 5 is a side elevational view of the motorcycle clutch tool of FIG. 4 illustrating a partially cut away ratchet drive tool for insertion into the female sprocket attached to the unitary disc of the clutch tool.

As best seen in FIG. 4, an alternative embodiment of the present invention replaces the handle 16 with a female socket 17 which is originally attached to the disc 14 such as by welding. The female socket is dimensioned for mating with the male socket 19 of a ratchet drive tool 21 as best seen in FIG. 5 and preferably has a ½ inch square socket hole. This particular embodiment of the present invention minimizes the size of the clutch plate tool 10 since the handle function is performed by the socket 17 and the ratchet drive tool, the drive tool being disengageable from the disc 14.

The disc 14 of the motorcycle clutch tool 10 is preferably made from a strong metallic material such as 3/16 inch steel. The handle may similarly be made of any suitable material having strong shear strength.

Thus, the present invention provides a motorcycle clutch tool for allowing a one-man operation instead of a standard two-man operation in disassembling a motorcycle clutch assembly. The motorcycle clutch tool locks the clutch shell to the inner clutch hub assembly thereby allowing for one-man removal of the clutch hub nut.

It will thus be seen that the objects set forth above, and those made apparent from the previous description, are efficiently attained and, since certain changes may be made in the above article without departing from the scope of the invention, it is intended that all matter contained in the above description shall be interpreted as illustrative and not in a limiting sense.

It is also to be understood that the following claims are intended to cover all the generic and specific features of the invention herein described, and all statements of the scope of the invention which, as a matter of language, might be said to fall therebetween.

Having described the invention, what is claimed is:

1. A motorcycle clutch tool for securing a clutch hub assembly to a clutch shell normally rotatable with respect to said hub so as to facilitate removal of a clutch hub nut and disassembly of a motorcycle clutch assembly, as well as to facilitate removal of the motorcycle drive sprocket from the associated drive shaft, comprising:

A. a unitary rigid substantially planar thin disc having a central aperture completely passing therethrough and having a diameter substantially greater than its thickness incorporating:
   a. first means about the outer periphery of said disc engageable with said clutch shell, and
   b. second means about the inner periphery of said disc aperture engageable with said clutch hub assembly; and B. a handle member, for attachment to the unitary disc, and when attached usefull for positioning and applying torque to said disc.

2. A motorcycle clutch tool as defined in claim 1, wherein said handle member incorporates a pair of arms perpendicularly connected to each other, one arm perpendicularly extending from said disc and the other arm radially extending from said disc in a plane substantially parallel to said disc.

3. A motorcycle clutch tool as defined in claim 1, wherein said handle member incorporates a ratchet driver mating socket securely attached to said disc and a ratcher driver tool for removable mating with said ratchet socket.

4. A motorcycle clutch tool as defined in claim 1, wherein said unitary rigid disc comprises approximately 0.093 inch thick homogeneous metal so as to provide for easy insertion of said tool within the clutch hub assembly and clutch shell without the need for removing more than one drive clutch plate and driven clutch plate of the clutch assembly.

5. A motorcycle clutch tool for use with a male ratchet driver tool for securing a clutch hub assembly to a clutch shell normally rotatable with respect to said hub so as to facilitate removal of a clutch hub nut and disassembly of a motorcycle clutch assembly, as well as to facilitate removal of the motorcycle drive sprocket from the associated drive shaft, comprising:

A. a unitary rigid substantially planar thin disc having a central aperture completely passing therethrough and having a diameter substantially greater that its thickness incorporating:
   a. first means about the outer periphery of said disc engageable with said clutch shell, and
   b. second means about the inner periphery of said disc engageable with said clutch hub assembly; and B. a female ratchet driver mating socket securely attached to said disc for mating with the male ratchet driver tool.

6. A motorcycle clutch tool for securing a clutch hub assembly to a clutch shell normally rotatable with respect to said hub so as to facilitate removal of a clutch hub nut and disassembly of a motorcycle clutch assembly, as well as to immobilize the drive chain, drive sprocket and drive shaft of the motorcycle, comprising:

A. a unitary homogeneous rigid substantially planar thin disc having a central aperture completely passing therethrough and having a diameter substantially greater than its thickness, a first plurality of outwardly radially extending members about the outer periphery of said disc for engagement with the inner periphery of said clutch shell, and a second plurality of inwardly circumferentially positioned members about the inner periphery of said disc for engagement with the outer periphery of said clutch hub assembly; and B. a handle connected to the disc for positioning and applying torque to said disc with respect to the clutch hub nut;

whereby maintenance and disassembly of the clutch assembly and drive sprocket from the drive shaft is facilitated.

7. A motorcycle clutch tool as defined in claim 6, wherein said handle incorporates a pair of arms perpendicularly connected to each other, one arm perpendicularly extending from said disc and the other arm radially extending from said disc in a plane substantially parallel to said disc.

* * * * *